US005592886A

United States Patent [19]

Williams et al.

[11] Patent Number: 5,592,886

[45] Date of Patent: Jan. 14, 1997

[54] ADJUSTABLE WALL-MOUNTED SYSTEM FOR SHELVES

[75] Inventors: Theodore G. Williams, Clarendon Hills; John P. Chap, Lemont; Mike Gadberry, Chicago, all of Ill.; William M. Covert, Flower Mount, Tex.

[73] Assignee: Amco Corporation, Chicago, Ill.

[21] Appl. No.: 189,150

[22] Filed: Jan. 31, 1994

[51] Int. Cl.[6] ..... A47B 9/00

[52] U.S. Cl. ..... 108/108; 108/157; 248/243; 248/250; 211/193

[58] Field of Search ..... 108/42, 107, 108, 108/110, 152; 248/243, 250; 211/190, 193

[56] References Cited

U.S. PATENT DOCUMENTS

| | | | |
|---|---|---|---|
| 392,061 | 10/1888 | Peckham . | |
| 1,324,537 | 12/1919 | Belcher . | |
| 1,698,975 | 1/1929 | Vance | 248/243 |
| 2,723,824 | 11/1955 | Martin | 248/200.1 |
| 2,729,342 | 1/1956 | Saul, Jr. . | |
| 2,975,908 | 3/1961 | Huet | 248/250 |
| 3,040,905 | 6/1962 | Gingher . | |
| 3,164,255 | 1/1965 | Jay | 211/193 |
| 3,194,528 | 7/1965 | Chesley . | |
| 3,212,836 | 10/1965 | Johnson . | |
| 3,353,684 | 11/1967 | Chesley . | |
| 3,424,111 | 1/1969 | Maslow . | |
| 3,523,508 | 8/1970 | Maslow . | |
| 3,556,306 | 1/1971 | Shell . | |
| 3,563,626 | 2/1971 | Ferdinand . | |
| 3,603,274 | 9/1971 | Ferdinand | 108/108 |
| 3,626,870 | 12/1971 | Schild . | |
| 3,965,826 | 6/1976 | Markham | 248/243 |
| 3,999,775 | 12/1976 | Brongo . | |
| 4,051,789 | 10/1977 | Howitt . | |
| 4,076,203 | 2/1978 | McDonnell . | |
| 4,079,678 | 3/1978 | Champagne . | |
| 4,086,858 | 5/1978 | Howitt . | |
| 4,122,955 | 10/1978 | Celms . | |
| 4,230,052 | 10/1980 | Champagne . | |
| 4,444,323 | 4/1984 | Travis . | |
| 4,457,239 | 7/1984 | Heinze . | |
| 5,004,302 | 4/1991 | Stocking . | |
| 5,062,605 | 11/1991 | Muhlethaler . | |

FOREIGN PATENT DOCUMENTS

| | | | |
|---|---|---|---|
| 0688318 | 6/1964 | Canada | 108/107 |
| 0798106 | 7/1958 | United Kingdom | 108/108 |

OTHER PUBLICATIONS

E–Z Shelving Systems, Inc., Buyline 3366 Catalog, pp. 1–8, Jan. 1992.

*Primary Examiner*—Peter M. Cuomo
*Assistant Examiner*—Gerald A. Anderson
*Attorney, Agent, or Firm*—Laff, Whitesel, Conte & Saret, Ltd.

[57] ABSTRACT

A wall-mounted shelving system provides for easy installation and adjustment in any number of configurations. The system includes at least one pair of vertical standards adapted to be mounted on a wall or similar supporting surface. Each standard is generally U-shaped with a backwall member adapted to be placed flush against a wall and two opposed arms extending outwardly from the backwall member. The backwall member is secured to the wall by rivets or any other suitable fastener. A ceiling mounting plate provides additional support for the standard. A plurality of keyhole slots are spaced along the pair of standard arms to receive shelf support brackets at any number of desired locations along the standard. The brackets are provided with shoulder rivets for removable engagement with the keyhole slots. The shelves are designed to snap fit over the front and back portions of the brackets to provide a secure engagement against accidental dislodgement.

10 Claims, 2 Drawing Sheets

FIG. 3
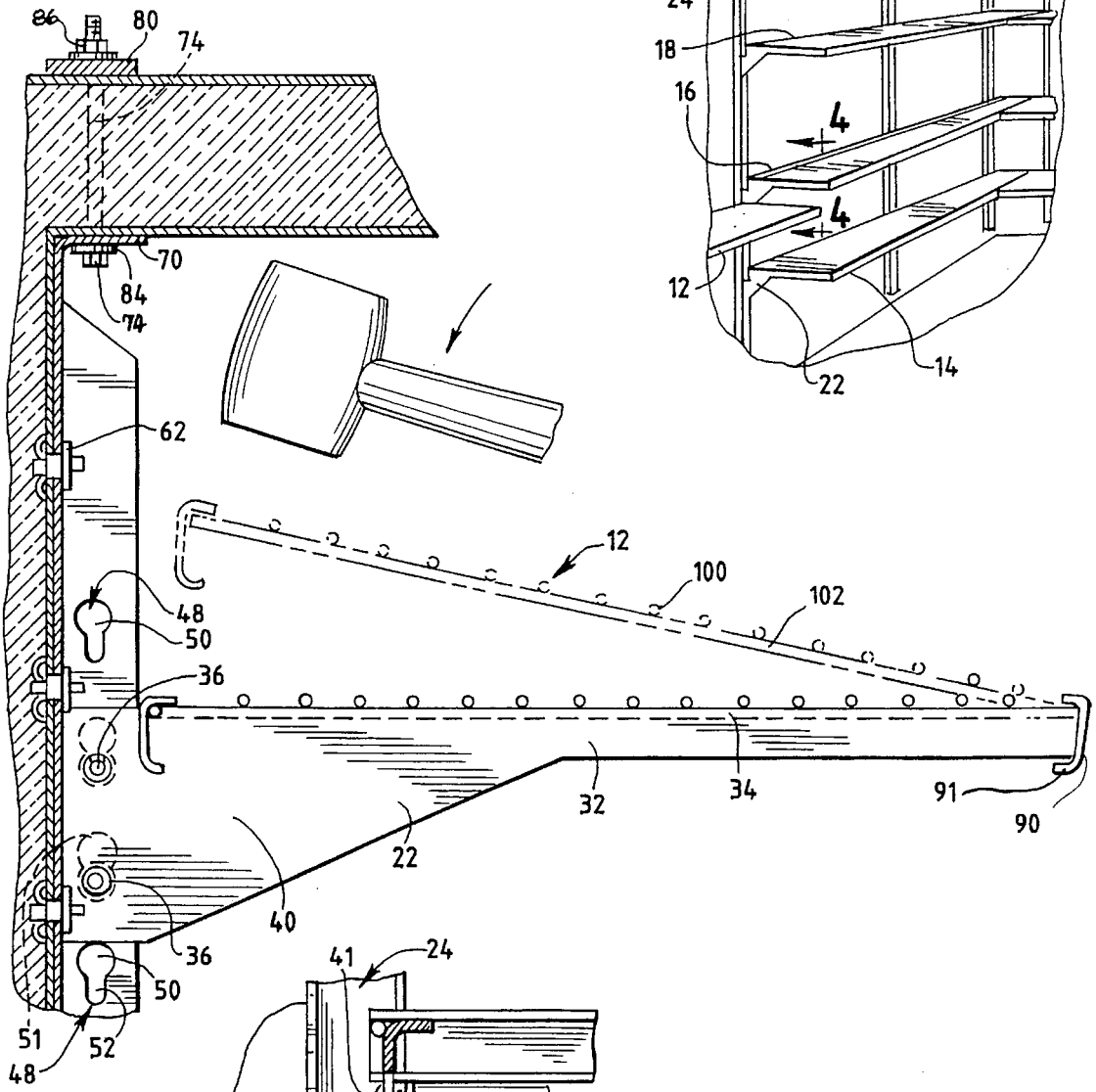
FIG. 2
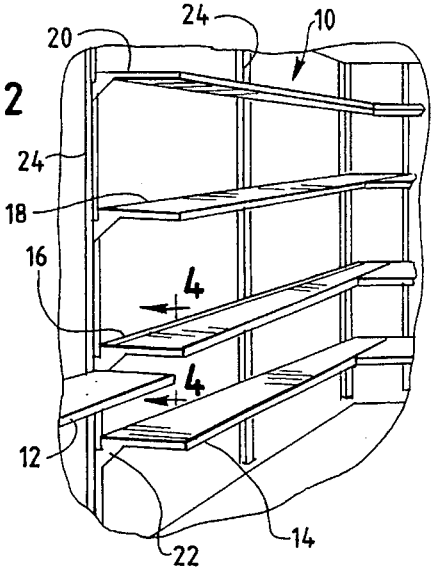
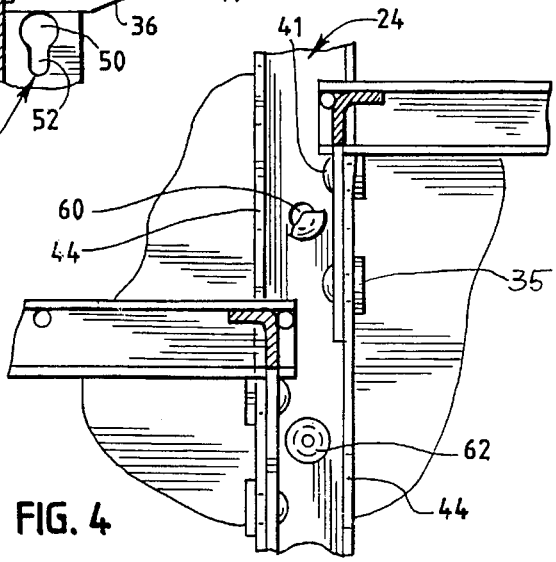
FIG. 4
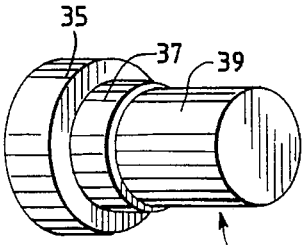
FIG. 5

ADJUSTABLE WALL-MOUNTED SYSTEM FOR SHELVES

FIELD OF THE INVENTION

The present invention relates to an adjustable wall-mounted system for shelves. More particularly, the present invention relates to a standard and bracket system for mounting a plurality of shelves on a wall to form an adjustable shelving system.

BACKGROUND OF THE INVENTION

Shelving systems comprising a plurality of flat shelves supported by several post members resting on a floor are known in the art. Such systems are often made of metal and are adjustable to vary shelf heights. Individual shelves can be secured to the posts at varying heights to accommodate and support items of various sizes, thus enabling great flexibility as product designs and storage requirements change. Such systems provide significant stability and load carrying capacity, which are important features. Adjustable shelving systems may be used in the home or in commercial situations, such as the food service industry, where considerations relating to sanitary conditions are important. For example, adjustable shelving systems have been described in U.S. Pat. Nos. 3,424,111 and 3,523,508.

Similarly, shelving systems comprising a plurality of flat shelves that are supported by braces or standards mounted on a wall are also known in the art. It is often desirable under certain circumstances to employ a wall-mounted system rather than a shelf assembly supported on the floor. For example, it may be desired not to have the shelving assembly rest on the floor in order to keep the floor clear of obstructions. Also, the configuration and size of the storage area may dictate that a wall-mounted system is more practical or efficient. Other reasons dictated by different storage requirements may also make a wall-mounted assembly more feasible than an assembly supported by posts resting on a floor. Although wall-mounted systems generally provide an adequate alternative to adjustable shelving systems supported on the floor, wall-mounted systems may not be as stable or provide as much load-carrying capacity as a system supported by the floor.

Accordingly, it is an object of the present invention to provide an adjustable wall-mounted shelving system for mounting a plurality of shelves on a wall or similar support surface at varying heights and in different configurations to meet various storage requirements while providing a stable structure with adequate load bearing capacity.

Another object of the present invention is to provide an adjustable wall-mounted shelving system which is easy and economical to manufacture and install.

A further object of the invention is to provide an adjustable wall-mounted shelving system that conforms to the requirements of the National Sanitation Foundation, which requirements must be satisfied if the shelving is to be used in the food service industry.

Still another object of the present invention is to provide an adjustable wall-mounted shelving system wherein individual shelves may be removed, added or adjusted in position without disturbing other shelves in the system.

SUMMARY OF THE INVENTION

In keeping with an aspect of the invention, these and other objects are accomplished by an adjustable wall-mounted shelving system with U-shaped vertical standards for mounting on a wall or similar support surface and which independently support adjacent shelves. At least one pair of standards are mounted at a desired location to a wall or similar support surface for supporting one or more shelves. Keyhole slots are formed along outwardly extending arms of the standards at regularly spaced intervals to receive shelf support brackets at varying heights along the standards.

Each shelf support bracket is provided with a pair of shoulder rivets for removable engagement with the keyhole slots. The brackets can be secured to the standards at any desired location by inserting the shoulder rivets through a corresponding pair of keyhole slots.

After a pair of brackets are secured to a corresponding pair of vertical standards at a desired location along the standards, a shelf is secured to the brackets by means of a secure snap fit over the front and back portions of the bracket. The brackets are securely held in place against the vertical standards to provide a stable configuration. Tension created in the shelf by snapping the shelf over the brackets provides a tight fit between the shelf and the bracket and helps to prevent against accidental dislodgement of the shelf from the brackets.

The design of the wall-mounted shelf system provides for a system which can be easily installed and adjusted in innumerable configurations to meet a variety of storage requirements. Each vertical standard can independently support adjacent shelves so that adjacent shelves can be placed at varying heights and shelves can be removed without disturbing other shelves in the system.

BRIEF DESCRIPTION OF THE DRAWINGS

A preferred embodiment of the invention is shown in the attached drawings, wherein:

FIG. 2 is a partial exploded perspective view of a shelf, bracket and standard to show mounting of the system to a wall and ceiling;

FIG. 3 is a partial cross-sectional view of a shelf, bracket and standard mounted in place;

FIG. 4 is partial front elevational view of two shelves mounted on the system taken along line 4—4 of FIG. 1; and FIG. 5 is an isometric view of a bracket rivet.

DETAILED DESCRIPTION OF THE INVENTION

Figure 1:
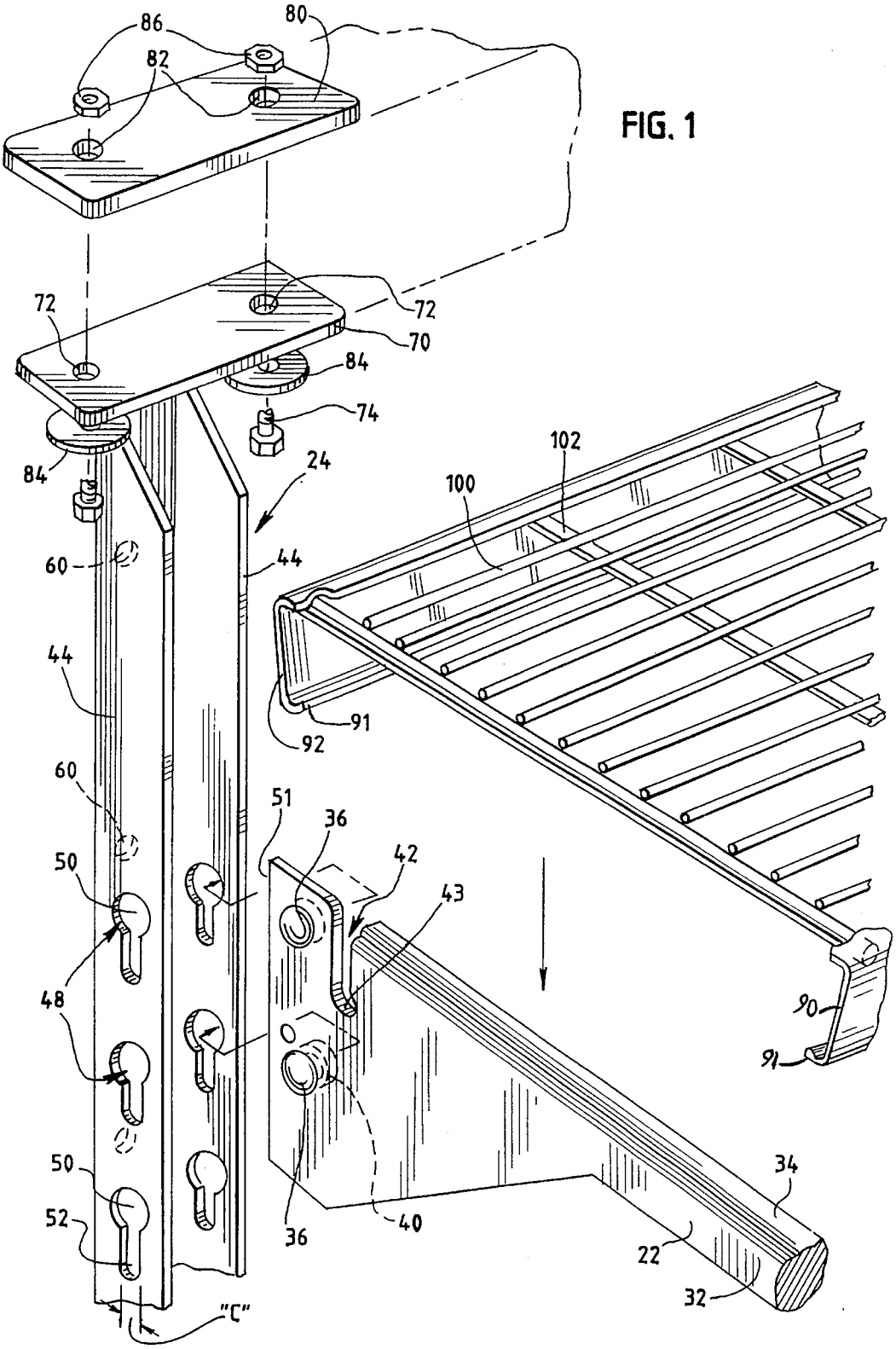
FIG. 1 is a partial perspective view of the assembled shelving system.

Referring to FIG. 1, shelf assembly 10 comprises a plurality of shelves including shelves 12, 14, 16 and 18 which are mounted to wall 20 by means of brackets 22 and standards 24. Depending on storage requirements, fewer or more shelves than those shown in FIG. 1 may comprise the shelf assembly.

As shown in FIGS. 2 and 3, elongated bracket 22 comprises a vertical section 32 and a horizontal support section 34 to receive and support a shelf. A pair of shoulder rivets 36 is pressed through a pair of holes (not shown) formed on the rear section 40 of bracket 22. Each shoulder rivet 36 (FIG. 5) comprises a flat head 35 with a round shoulder section 37 extending outwardly therefrom. A shank portion 39 which is slightly smaller in diameter than the shoulder 37 extends outwardly from the shoulder 37 opposite the flat head 35. The shank 39 is adapted to be inserted through the holes (not shown) on section 40 in a relatively tight press fit. Because the diameter of shoulder 37 is larger than the diameter of the holes on bracket 22, the shoulder acts as a stop abutting against section 40. After rivet 36 is pressed into place in section 40, a portion of shank 39 will extend outward from bracket 22. A rivet head 41 (FIG. 4) is then cold formed on the outwardly extending end of shank 39 by a rivet die or similar stamping process, permanently securing the rivet 36 in the hole on bracket 22.

Referring to FIGS. 2 and 4, standard 24 is formed from a U-shaped member with legs 44 extending outwardly from the backwall 46. Keyhole slots 48 are spaced at regular intervals along legs 44 and are sized to receive shoulder rivets 36. In a preferred embodiment, standards 24 are constructed of No. 11 (0.120") gauge cold rolled steel and keyhole slots 48 are punched in legs 44 on 2¼" centers. Slot 48 is formed with an opening 50 at its top which is sized large enough to receive the flat head 35 of rivet 36. A narrower, elongate opening 52 extends downward from opening 50. The cross-section dimension "c" of opening 52 is slightly less than the diameter of the flat head 35 of rivet 36, but slightly greater than the diameter of shoulder 37. As a result, after the flat head 35 of rivet 36 is inserted into opening 50 and dropped down into opening 52 of keyhole slot 48, the rivet 36 will be held securely in place to engage bracket 22 with standard 24.

In order to disengage bracket 22 from the standard 24, bracket 22 must be lifted upwardly so that rivet 36 can be removed from the keyhole slot 48 through opening 50. Thus, when a shelf is loaded, the weight of the load will help to keep the brackets 22 secured in the keyhole slots 48 of standard 24.

When brackets 22 are locked into place in keyhole slots 48, the back edge 51 of each bracket 22 firmly abuts the backwall 46 of standard 24. This abutting relationship between the back edge 51 of bracket 22 and the backwall 46 provides additional support to bracket 22 for the downward load exerted by the loaded shelves. In addition, the rear section 40 of bracket 22 is firmly held against one of the legs 44 of the standard. When a shelf is secured to a pair of brackets 22 which are locked onto standards 24, the abutting force of legs 44 helps to prevent lateral sway of the brackets 22.

Rivet mounting holes 60 are provided at regular intervals in the backwall 46 of standard 24 to receive rivets 62 for mounting the standard 24 to a wall or similar supporting surface. Depending on the type of supporting surface to which the standards 24 will be secured, lag bolts or other suitable attachment means (not shown) may be used instead of rivets 62.

A ceiling mounting plate 70 is formed at the top of standard 24 to provide additional means for securing standard 24 in place. Two holes 72 are formed in plate 70 to receive bolts or threaded rods 74 or any other suitable fastening means.

For use in a refrigeration unit such as is often found in restaurants and other commercial or institutional kitchens, an additional ceiling plate 80 is used to secure the standard 24 to the ceiling. Commonly, the walls and ceiling of commercial refrigeration units are 3½ to 4½ inches thick comprising urethane foam insulation covered by a steel skin. Such refrigeration units may be anywhere from four by six feet in size or larger. As shown in FIGS. 2 and 3, threaded rods 74 are inserted through holes 72 in plate 70 and holes 82 in plate 80. Washers 84 and hex nuts 86 secure the threaded rods in place.

To assemble shelf assembly 10, the desired configuration and number of individual shelves are first determined. The required number of standards 24 are then mounted to the supporting walls and ceiling by means of rivets 62 (or other suitable fasteners) and bolts or threaded rods 74. If the shelving assembly is set up in a refrigeration unit, ceiling plate 80 is also used as described above.

Once standards 24 are mounted, brackets 22 are mounted to the standards by securing the shoulder rivets 36 in keyhole slots 48. Shelves 12, 14, 16 and 18 are next secured to the brackets 22. The channels 90, 92 which run along the front and back of the shelf form a lower hook portion 91 for fitting over and securing the shelf to the bracket. In a preferred embodiment, channels 90, 92 are ⅝"×1¼"×0.105" thick. The front channel 90 is first placed over and secured to the front of the bracket 22 as shown in FIG. 3 in a secure snap fit. The back of the shelf is then lowered onto bracket 22 so that the rear channel 92 locks into slot 42 located near the rear of bracket 22. The lower lip of the c-clip formed by channel 92 locks in bend 43 at the lower end of slot 42 to provide a secure snap fit.

In the preferred embodiment, the shelves are formed from a plurality of No. 8 gauge (0.162") crosswires 100 spaced 1 1/16 inch on centers with crossbraces 102 of 5/16 inches (0.3125") on six inch centers which run perpendicular to the cross wires 100. The crosswires 100 are welded to the crossbraces 102 and the crossbraces are welded to channels 90, 92.

As a result of the manufacturing process, the shelves usually are somewhat bowed and are not perfectly flat. As a result, in order to securely lock the rear shelf channel 92 into the channel 42 of bracket 22, it may be desirable to use a rubber hammer or similar implement to gently pound the rear of the shelf downward and lock the rear channel 92 into place (FIG. 3). Pounding the rear of the shelf into locking engagement with the bracket channel 42 causes the steel crosswires 100 and crossbraces 102 to flex and straighten out so that the shelf flattens out on brackets 22. The flexing and straightening of the crosswires 100 and crossbraces 102 create tension in the shelf to tightly secure shelf channel 90 around the front of the bracket 22 and shelf channel 92 in channel 42. The tight snap fit of the shelf on bracket 22 created by the tension in the shelf helps to prevent accidental disengagement of the shelf from brackets 22.

By repeating the above-described process, additional shelves can be added to or removed from assembly 10 as desired to meet different storage requirements. Each standard 24 can independently support adjacent brackets 22 so that adjacent shelves can be independently mounted. Thus, each shelf can be positioned without disturbing adjacent shelves or shelves above or below. In addition, adjacent shelves can be positioned at varying heights (FIG. 4) resulting in a highly flexible system which can be easily arranged in a variety of configurations to meet different storage requirements. There are no front post barriers to limit accessibility to the shelves.

Because the standards rest flush against the supporting wall, no enclosed or hidden spaces are formed which might collect dirt or provide refuge for vermin. In addition, the U-shaped configuration of each standard provides an open easily accessible structure for cleaning.

Those who are skilled in the art will readily perceive how to modify the adjustable wall-mounted shelf assembly. Therefore, the appended claims are to be construed to cover all equivalent structures which fall within the true scope and spirit of the invention.

The invention claimed is:

1. A shelf system for mounting on a wall comprising:

a) at least one shelf;

b) at least one pair of standards adapted to be mounted on said wall, wherein said standards each comprise a U-shaped member with a backwall portion adapted to be mounted to said wall and two arms extending outwardly from said backwall;

c) a plurality of keyhole slots spaced along each of said arms;

d) at least one pair of brackets adapted to be removably secured to said pair of standards to receive and support said shelf, each of said brackets having a front end and a back end, with a downwardly extending slot formed near the back end of the bracket, said back end of said brackets abutting against said backwall portion of said standards when said brackets are secured to said standards; and e) said shelf having first means for fitting over and engaging the front end of said bracket and second means for fitting into and engaging said downwardly extending slot formed near the back of said bracket, said first and second means including lower hook portions for engaging said bracket.

2. The shelf system of claim 1 wherein said brackets abut against one of said two arms of said standards when said brackets are secured to said standards.

3. A shelf system for mounting on a wall comprising:

a) at least one shelf;

b) at least one pair of standards adapted to be mounted on said wall, wherein said standards each comprise a U-shaped member with a backwall portion adapted to be mounted to said wall and two arms extending outwardly from said backwall;

c) a plurality of keyhole slots spaced along each of said arms;

d) at least one pair of brackets adapted to be removably secured to said pair of standards to receive and support said shelf, each of said brackets abutting against one of said two arms of said standards; and e) said shelf having means for engaging said bracket to removably secure said shelf to the brackets.

4. The shelf system of claim 3 wherein:

a) each of said brackets has a downwardly extending slot formed near the back end of the brackets; and b) said means for engaging said brackets has first means for fitting over and engaging the front end of said brackets and second means for fitting into and engaging said downwardly extending slot formed near the back of said brackets, said first and second means including lower hook portions for engaging said brackets.

5. A shelf system for mounting on a wall comprising:

a) at least one shelf;

b) at least one pair of standards adapted to be mounted on said wall, wherein said standards each comprise a U-shaped member with a backwall portion adapted to be mounted to said wall and two arms extending outwardly from said backwall;

c) a plurality of keyhole slots spaced along each of said arms;

d) at least one pair of brackets adapted to be removably secured to said pair of standards to receive and support said shelf, each of said brackets having a front end a back end and a slot having at least one non-linear portion, said slot formed near the back end of the brackets; and e) said shelf having first means for fitting over and engaging the front end of said brackets and second means for fitting into and engaging said slot formed near the back of said brackets, said first and second means including lower hook portions for engaging said brackets.

6. A shelf system for mounting on a wall comprising:

a) at least one shelf;

b) at least one pair of standards adapted to be mounted on said wall, wherein said standards each comprise a U-shaped member with a backwall portion adapted to be mounted to said wall and two arms extending outwardly from said backwall;

c) a plurality of keyhole slots spaced along each of said arms;

d) at least one pair of brackets adapted to be removably secured to said pair of standards to receive and support said shelf, each of said brackets having a front end and a back end; and e) said shelf fitting over and engaging the front and back ends of each of said brackets by flexing so as to cause tension in said shelf so that a tight snap fit is created to engage said brackets.

7. The shelf system of claim 6 wherein each of the brackets has a downwardly extending slot formed near the back end of the brackets, and said means for fitting over and engaging the back end of said brackets comprises a lower hook portion for engaging said slot.

8. The shelf system of claims 1, 3, 4, 5, or 6 further comprising means for mounting said standards to a ceiling.

9. The shelf system of claim 8 wherein said means for mounting said standards to a ceiling comprises at least one plate associated with each of said standards, said plate adapted to be placed against a ceiling and having at least one aperture, and at least one bolt adapted to be inserted through said aperture for securing the plate to the ceiling.

10. The shelf system of claim 8 wherein said ceiling is of a type having opposing first and second surfaces and said means for mounting said standards to a ceiling comprises a first and second cooperating plate associated with each of said standards, said first plate adapted to be placed against the first surface of the ceiling and said second plate adapted to be placed against the second surface of the ceiling, each of said cooperating plates having at least one aperture, and at least one bolt adapted to be inserted through said apertures for securing the cooperating plates to the ceiling.

* * * * *